United States Patent [19]

Wessiepe et al.

[11] Patent Number: 4,986,032

[45] Date of Patent: Jan. 22, 1991

[54] DOOR

[75] Inventors: Klaus Wessiepe, Essen; Wilhelm Stewen, Oberhausen, both of Fed. Rep. of Germany

[73] Assignee: Ruhrkohle AG, Essen, Fed. Rep. of Germany

[21] Appl. No.: 508,493

[22] Filed: Apr. 10, 1990

Related U.S. Application Data

[63] Continuation of Ser. No. 285,837, Dec. 15, 1988, abandoned.

[51] Int. Cl.[5] ..... E06B 7/16

[52] U.S. Cl. ..... 49/477; 202/248; 292/33

[58] Field of Search ..... 49/9, 209, 477, 480; 202/248, 242; 292/33, 302; 110/176, 180

[56] References Cited

U.S. PATENT DOCUMENTS

| | | | |
|---|---|---|---|
| 2,703,250 | 3/1955 | Wolff | 202/248 |
| 3,500,584 | 3/1970 | Clery et al. | 49/209 |
| 3,933,598 | 1/1976 | Pries | 202/248 |
| 4,683,032 | 7/1987 | Becker et al. | 202/248 |
| 4,740,271 | 4/1988 | Becker et al. | 202/248 |
| 4,741,809 | 5/1988 | Becker et al. | 202/248 |

FOREIGN PATENT DOCUMENTS

| | | | |
|---|---|---|---|
| 455265 | 1/1928 | Fed. Rep. of Germany . | |
| 8313165 | 11/1983 | Fed. Rep. of Germany . | |
| 1252231 | 12/1960 | France | 49/477 |
| 0545058 | 6/1956 | Italy | 49/477 |
| 0138293 | 8/1984 | Japan | 202/248 |

*Primary Examiner*—Kenneth J. Dorner
*Assistant Examiner*—Gerald A. Anderson
*Attorney, Agent, or Firm*—Nils H. Ljungman & Associates

[57] ABSTRACT

The door has a separate seal element and a hollow profile frame. The hollow profile frame has a number of tappets extending therefrom to press the seal element against a door frame. These tappets are applied individually to the seal element by pressure from a pneumatic hose within the hollow profile frame which applies pressure to the tappets.

14 Claims, 1 Drawing Sheet

DOOR

This application is a continuation of U.S. Application Ser. No. 07/285,837, filed on Dec. 15, 1988 now abandoned.

BACKGROUND OF THE INVENTION

1. Field of the Invention:

This invention relates to a door with a separate seal element, which is pressed against the chamber frame by means of a number of adjustment devices located in the vicinity of the seal surface around the seal element.

2. Description of the Prior Art:

While doors of the prior art were often made of a solid casting, profile beams are generally currently used, which can be worked into a welded frame structure for doors. The sizing of the hollow profile beam is determined on the basis of static requirements, which are characterized by mechanical and superimposed other stresses on the door construction. Outside the door frame may be a sealing element, which for its part is pressed against the chamber frame to improve the seal.

The application pressure can be exerted, for example, by screws which are tightened through the hollow profile beams and act on the seal element. Each of these screws must be adjusted manually, without any clear determination of the application pressure. For example, there is no guaranteed torque limitation when the screws are tightened. Another serious disadvantage of this design of the prior art is the positive connection between the hollow profile body and the devices to adjust the seal element. Any deformation of the hollow profile structure has a direct effect on this apparatus, in this case the screws in their position in relation to the seal element, which changes the resulting application pressure. It is therefore necessary to produce a dynamic separation between the door body and the apparatus used to adjust the seal element.

The separation between the door body and the seal element may be achieved, for example, by introducing a chain extending all the way around inside the hollow profile body, which tightens all the screws to the same degree to apply pressure to the seal element or loosens them to remove the door. The application pressure can be set as a function of the movement of the chain. With this solution, however, all the screws are tightened equally, and local uneven spots on the chamber frame, such as those caused by deposits, i.e. all deviations from linearity, are not taken into consideration. The apparatus to adjust the seal element in this case is inflexible and rigid. The application pressure therefore varies as a function of local conditions at the various points of the seal element.

OBJECTS OF THE INVENTION

One object of the invention therefore is not only to make possible the dynamic separation between the door body and seal element, but also the individual adJustment of each individual application apparatus.

Another object of the invention is to provide a door which will adapt to uneven surfaces of a door frame.

SUMMARY OF THE INVENTION

According to the invention, in the hollow profile door frame there is a hose running all the way around, which is inflated after the door is installed and, if necessary, is pressurized :with appropriate cooling media (e.g. by means of the pneumatic equipment). As a result of the inflation, the tappets guided through the frame on the seal element are pressed against the seal element. Depending on the design of the hollow profile beam, there can also be direct contact between the pressure hose and the seal element or between the pressure hose and the chamber frame itself. This arrangement requires that the pressure hose either be thermally resistant and/or that the heat produced be effectively removed (e.g. by partial filling of the hose with water or other fluid or gaseous media). Suitable materials for the hose may be a silicone rubber or a Teflon (a registered trademark of the E I Du Pont De Nemours & Company of Wilmington, Delaware). There are suitable relief valves to protect against overpressure (not shown, but notoriously well known in the art). Local uneven spots can be compensated for by the flexibility of the hose. At all the elevated spots on the chamber frame, the return force acting on the tappets will be increased, and the tappets will not be inserted as far as in neighboring areas, in which there are no local elevated spots on the chamber frame. Thus, with the arrangement proposed by the invention, the second basic requirement, besides the dynamic separation of door body and seal element, can be achieved: Substantially, the same application pressure is exerted on the seal element at all points, independently of all local differences in height and deviations from linearity. Once this ideal condition is fulfilled, the seal of the coke oven door must also remain good after long operation. Substantially, all or at least a number of deviations from linearity, including those caused by aging, are generally compensated by the flexible application system. Each point of the seal element is treated substantially individually by the automatic adjustment of the return force, and therefore with the resulting application pressure, which is substantially the same or similar at all points. Over wide areas, the application pressure can be adjusted individually, independently of the installation-specific conditions.

An aspect of the invention resides broadly in a door assembly for substantially closing a door opening, the door assembly comprising: a sealing element for being disposed adjacent to an outer surface of the periphery of the door opening, and substantially closing the door opening; and a frame member arrangement for being disposed about and adjacent to an outer surface of the periphery of the door opening: the frame arrangement comprising an inflatable arrangement and a plurality of force generating arrangements for applying a plurality of forces to the sealing element about the periphery of a door opening: the inflatable arrangement being disposed to extend the plurality of force generating arrangements adjacent the sealing element at a plurality of points for pressing the sealing element against the periphery of a door opening.

DESCRIPTION OF THE PREFERRED EMBODIMENTS

Figure 1:
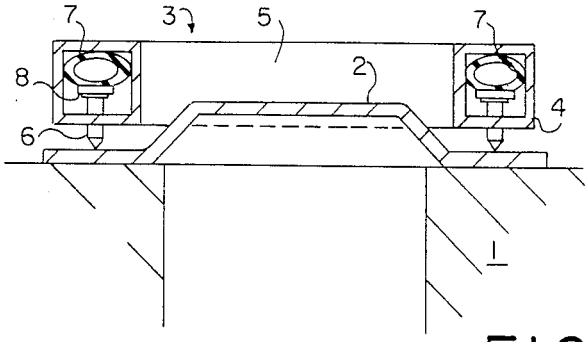
FIG. 1 shows a top sectional view of an embodiment of the invention.

The accompanying drawing illustrates one embodiment of the invention. The figure shows a horizontal section through a vertical coke oven. The chamber frame of the coke oven is designated 1. A seal element 2 of a coke oven door is shown in contact with the chamber frame 1. The sealing element 2 is preferably made of sheet metal having a substantially smaller thickness dimension than the height and the width thereof. Sealing elements and other features of doors are shown in U.S. Pat. Nos. 4,683,032: 4,740,271 and 4,741,809. The sealing element 2 consists of a metal sheet bent outward between the seal surfaces. The sealing element 2 is pressed against the chamber frame by means of a hollow profile frame 3. The hollow profile frame 3 consists of longitudinal beams 4 and transverse beams 5. The hollow profile frame 3 is engaged, in a manner not shown, with the longitudinal beams 4 by means of locking hooks, which are mounted on the chamber frame. Some examples of locking means are shown in U.S. Pat. Nos. 4,647,342; 4,254,974: 4,028,193: 3,953,063 and 3,902,274. In the profile frame 3, preferably at substantial equal intervals, there are movable tappets 6. The tappets 6 are preferably simple bolts. Also surrounding the hollow profile frame 3 is a pneumatic hose 7. All the tappets 6 are preferably in contact with the pneumatic hose 7. The tappets 6 preferably have wide heads 8. The pneumatic hose forms the adjustment described by the invention of the tappets 6. The pneumatic hose thereby expands variably in the illustrated operating position as a function of the variable distance between the lateral flanks of the seal element 2 and the hollow profile frame 3.

Figure 2:
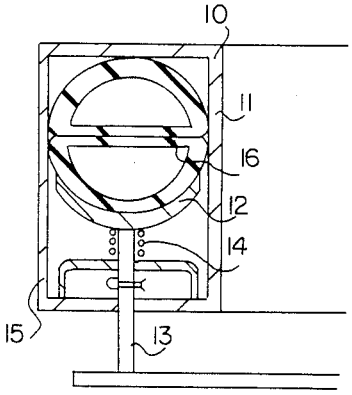
FIG. 2 shows a detailed sectional view of a portion of an alternative of the invention.

FIG. 2 shows a hollow profile frame 10 instead of the hollow profile frame 5. In the hollow profile frame 10 there is a two-chamber pneumatic hose 11. The two-chamber pneumatic hose acts by means of heads 12 on tappets 13, whereby the heads 12 are adapted to the shape of the pneumatic hose 11, and there are return springs 14 between the heads 12 and the opposite portion of the chamber frame 10, or spacers 15.

The two-chamber pneumatic hose 11 preferably has a round cross section with a web 16 which, in the drawing, runs parallel to the plane of the seal surface. The two-chamber design has the advantage that in case of a leak in one chamber, the other chamber can immediately be pressurized with compressed air. The door seal is therefore guaranteed almost at all times.

Preferably, not only is the head 12 adapted to the shape of the hose, but other parts which interact with the hose are also adapted to the shape of the hose. Such a situation is illustrated by way of Example in FIG. 3. In the Figures, there is a rounded chamber frame 21 at the contact surface with the hose 20. The hose 20, in contrast to the hose 11, which comprises two separately fabricated hoses, which are attached to one another in the contact area by means of adhesive. The two hoses can also be bonded together, if necessary.

The back-and-forth tappet designated 22 is limited by stops 23 and 24. There are also several return springs 25 and 26. Some examples of door closures are found in U.S. Pat. Nos. 4,647,342: 4,254,974; 4,028,193; 3,953,063 and 3,902,274. All documents cited herein are incorporated by reference as if the entire contents thereof were fully set forth herein.

To recapitulate some aspects of the invention:

This invention relates to a door with a separate seal element, which is pressed against the chamber frame by means of a number of adjustment devices located in the vicinity of the seal surface around the seal element.

While doors of the prior art were often made of a solid casting, profile beams are generally currently used, which can be worked into a welded frame structure for doors. The sizing of the hollow profile beam is determined on the basis of static requirements, which are characterized by mechanical and superimposed other stresses on the door construction. Outside the door frame may be a sealing element, which for its part is pressed against the chamber frame to improve the seal.

In summing up, some embodiments of the invention reside in the following aspects.

One aspect of the invention resides in a coke oven door with separate seal element, which is pressed against the chamber frame by a hollow profile frame by means of a number of adjustment devices located all around the seal element in the vicinity of the seal surface, characterized by the fact that the adjustment devices are designed as tappets (6) and are in contact with a pressurized hose (7).

Another aspect of the invention resides in that the pressurized hose (7) is a pneumatic hose.

Yet another aspect of the invention resides in a hose which is a multi-chamber hose (11, 20).

Still another aspect of the invention resides wherein the multi-chamber hose (11, 20) has a web (16) shaped into it, or comprises several hoses.

A further aspect of the invention resides in that the parts interacting with the hose (7, 11, 20) are adapted to the shape of the hose.

Other aspects of the invention relate to:

One embodiment of the invention relates to a door assembly for substantially closing a door opening, said door assembly comprising:

a sealing element for being disposed adjacent to an outer surface of the periphery of said door opening, and substantially closing said door opening: and frame member means for being disposed about and adjacent to an outer surface of the periphery of said door opening:

said frame means comprising inflatable means and a plurality of force generating means for applying a plurality of forces to said sealing element about the periphery of a door opening;

said inflatable means being disposed to extend said plurality of force generating means adjacent said sealing element at a plurality of points for pressing said sealing element against the periphery of a door opening.

Another embodiment of the invention relates to a door assembly for substantially closing a door opening, wherein said frame member means comprises a hollow profile frame.

Yet another embodiment of the invention relates to a door assembly for substantially closing a door opening, wherein said inflatable means is disposed within said hollow profile frame.

Still another embodiment of the invention relates to a door assembly for substantially closing a door opening, wherein said inflatable means comprises at least one inflatable hose.

A further embodiment of the invention relates to a door assembly for substantially closing a door opening, wherein said sealing element comprises a light weight shield.

Another further embodiment of the invention relates to a door assembly for substantially closing a door opening, wherein said light weight shield comprises sheet metal.

Yet another further embodiment of the invention relates to a door assembly for substantially closing a door opening, wherein said plurality of force applying means comprises slidable elements for sliding back and forth within said frame means.

Still another further embodiment of the invention relates to a door assembly for substantially closing a door opening, wherein said slidable elements comprise elongated cylindrical elements disposed in holes in said frame member means which comprises a hollow profile frame.

Another embodiment of the invention relates to a door assembly for substantially closing a door opening, wherein said slidable elements comprise tappets.

Yet another embodiment of the invention relates to a door assembly for substantially closing a door opening, wherein said at least one inflatable hose comprises at least one pneumatic hose.

Still another embodiment of the invention relates to a door assembly for substantially closing a door opening, wherein said at least one inflatable hose comprises at least one multi-chambered hose.

A further embodiment of the invention relates to a door assembly for substantially closing a door opening, wherein said at least one multi-chambered hose comprises a web therein.

Another further embodiment of the invention relates to a door assembly for substantially closing a door opening, wherein said at least one multi-chambered hose comprises several hoses.

Yet another further embodiment of the invention relates to a door assembly for substantially closing a door opening, wherein said frame member means comprises means adapted to fit against the at least one shape of said inflatable means.

The invention as described hereinabove in the context of the preferred embodiments is not to be taken as limited to all of the provided details thereof, since modifications and variations thereof may be made without departing from the spirit and scope of the invention.

What is claimed is:

1. A coke oven door assembly for substantially closing a coke oven door opening and for compensating for uneven surfaces of the coke oven door opening, said coke oven door assembly comprising:

a sealing element for being disposed adjacent to an outer surface of the periphery of said coke oven door opening, and substantially closing said coke oven door opening; and frame member means for being disposed about and adjacent to an outer surface of the periphery of said coke oven door opening;

said frame member means comprising inflatable means and a plurality of force generating means for applying a plurality of forces to said sealing element about the periphery of said coke oven door opening;

said inflatable means being disposed to extend said plurality of force generating means adjacent said sealing element at a plurality of points for pressing said sealing element against the periphery of said coke oven door opening;

said sealing element comprising a light weight shield;

said light weight shield comprising sheet metal;

said frame member means comprising a hollow profile frame having at least one end;

said inflatable means being disposed within said hollow profile frame;

said inflatable means comprising at least one inflatable hose;

said plurality of force generating means comprising slidable tappets for sliding back and forth within said frame means;

said slidable tappets comprising elongated cylindrical elements disposed in holes in said frame member means;

said tappets including head means in contact with said at least one inflatable hose;

said at least one inflatable hose applying substantially equal force to all of said slidable tappets;

said at least one inflatable hose is configured to receive a coolant therein;

said at least one inflatable hose is positioned at the end of said frame that is farthest away from said coke oven door opening; and said tappets are interposed between said at least one inflatable hose and said sealing element to maintain a sufficient separation between said at least one inflatable hose and said coke oven door opening to minimize heat transfer from said coke oven door opening to said at least one inflatable hose.

2. A door assembly for substantially closing a door opening according to claim 1, wherein said frame member means comprises means adapted to fit against said inflatable means.

3. A door assembly for substantially closing a door opening according to claim 1, wherein said at least one inflatable hose comprises at least one pneumatic hose.

4. The coke oven door assembly of claim 3, wherein:

said sealing element defines an out of planar configuration;

said coke oven door assembly further including coolant means positioned within said at least one inflatable hose;

said at least one inflatable hose is constructed essentially from at least one material selected from the group consisting of: a) teflon, b) silicone, c) rubber, and d) silicone rubber;

said at least one inflatable hose has an at least partial oval cross-sectional configuration;

said tappets comprise a head portion and a stem portion;

said head portion has at least one dimension that is larger than at least one dimension of said stem portion;

said head portion is configured to bear against at least one of said at least one inflatable hose;

said sealing element has at least four obtuse bends; and said hollow profile frame has a substantially square cross section.

5. The coke oven door assembly of claim 4, wherein:

said inflatable means is configured to be at least partially filled with water;

at least one said inflatable hose is configured to provide said compensating of uneven surfaces of the coke oven door opening;

said tappets comprise bolt means;

at least one said inflatable hose is a pneumatic hose; and said tappets comprise adjustment devices that are positioned adjacent said sealing element.

6. A door assembly for substantially closing a door opening according to claim 3, wherein said at least one inflatable hose comprises at least one multi-chambered hose.

7. A door assembly for substantially closing a door opening according to claim 6, wherein said at least one multi-chambered hose comprises a web therein.

8. A door assembly for substantially closing a door opening according to claim 6, wherein said at least one multi-chambered hose comprises several hoses.

9. The coke oven door assembly o claim 8, wherein said hollow profile frame has a substantially rectangular cross-section:

wherein said sealing element defines an out of planar configuration;

said coke oven door assembly further including coolant means positioned within said at least one inflatable hose;

further including biasing means for moving said tappets relative to said hollow profile frame;

wherein said biasing means is spring means;

wherein said at least one inflatable hose is constructed essentially from at least one material selected from the group of: a) teflon, b) silicone, c) rubber, and d) silicone rubber; and wherein at least one of said several hoses has a generally D-shaped cross-section.

10. The coke oven door of claim 9, wherein:

said tappets comprise a head portion and a stem portion;

said head portion has at least one dimension that is larger than at least one dimension of said stem portion;

said head portion is at least partially curved; and said head portion is configured to bear against at least one of said several hoses; and further including stop means for limiting the length of travel of said tappets, said stop means being positioned on said stem portions of said tappets.

11. The coke oven door assembly of claim 10, wherein said inflatable means is configured to be at least partially filled with water;

wherein at least one said inflatable hose is configured to provide said compensating for uneven surfaces of the coke oven door opening;

wherein said tappets comprise bolt means;

wherein at least one said inflatable hose is a pneumatic hose;

wherein said several hoses are configured to facilitate the generally immediate pressurization of at least one of said hoses if another of said hoses develops a leak; and wherein at least two of said several hoses are bonded together by at least one adhesive.

12. The coke oven door assembly of claim 8, wherein said hollow profile frame has an at least partially rounded cross-section;

wherein said sealing element defines an out of planar configuration;

said coke oven door further including coolant means positioned within said at least one inflatable hose;

said coke oven door further including biasing means for moving said tappets relative to said hollow profile frame;

wherein said biasing means is spring means; and wherein said at least one inflatable hose is constructed essentially from at least one material selected from the group of: a) teflon, b) silicone, c) rubber, and d) silicone rubber.

13. The coke oven door assembly of claim 12, wherein:

at least one of said several hoses has a generally D-shaped cross-section;

said tappets comprise a head portion and a stem portion;

said head portion has at least one dimension that is larger than at least one dimension of said stem portion;

said head portion is at least partially curved;

said head portion is configured to bear against at least one of said several hoses; and further including stop means for limiting the length of travel of said tappets, said stop means for being positioned on said stem portion of said tappets.

14. The coke oven door assembly of claim 13, wherein said inflatable means is configured to be at least partially filled with water;

wherein at least one said inflatable hose is configured to provide said compensating for uneven surfaces of the coke oven door opening;

wherein said tappets comprise bolt means;

wherein at least one said inflatable hose is a pneumatic hose;

wherein said several hoses are configured to facilitate the generally immediate pressurization of at least one of said hoses if another of said hoses develops a leak;

wherein at least two of said several hoses are bonded together by at least one adhesive; and wherein said tappets comprise adjustment devices that are positioned adjacent said sealing element.

* * * * *

UNITED STATES PATENT AND TRADEMARK OFFICE

CERTIFICATE OF CORRECTION

PATENT NO. : 4,986,032

DATED : January 22, 1991

INVENTOR(S) : Klaus Wessiepe and Wilhelm Stewen

It is certified that error appears in the above-identified patent and that said Letters Patent is hereby corrected as shown below:

In column 2, line 1, after 'pressurized', delete ":".

In column 2, line 48, after 'opening', delete ":" and insert --;--.

In column 2, line 52, after 'opening', delete ":" and insert --;--.

In column 3, line 7, after '4,683,032', delete ":" and insert --;--.

In column 3, line 17, after '4,254,974', delete ":" and insert --;--.

In column 3, line 17, after '4,028,193', delete ":" and insert --;--.

In column 3, line 18, after 'the', insert --hollow--.

In column 3, line 49, after the first instance of 'the', delete "Figures" and insert --Figure--.

UNITED STATES PATENT AND TRADEMARK OFFICE

CERTIFICATE OF CORRECTION

PATENT NO. : 4,986,032

DATED : January 22, 1991

INVENTOR(S) : Klaus Wessiepe and Wilhelm Stewen

It is certified that error appears in the above-identified patent and that said Letters Patent is hereby corrected as shown below:

In column 3, line 58, after '4,647,342', delete ":" and insert --;--.

In column 4, line 35, after 'opening', delete ":" and insert --;--.

In column 4, line 38, after 'opening', delete ":" and insert --;--.

In Claim 5, line 5, after 'compensating', delete "of" and insert --for--.

On the Title page, after INID code section [22], please insert a new INID code section [30]. It should read:

-- Foreign Application Priority Data
December 23, 1987 [DE] Fed. Rep. of Germany ..... 3743692--.

Figure 3:
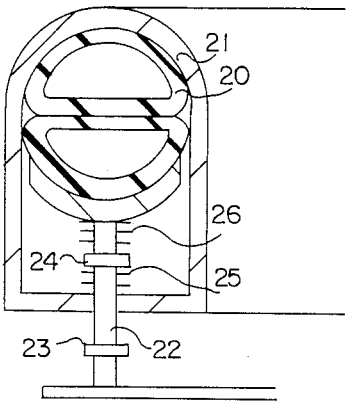

In column 2, line 63, please insert the following:

--Fig. 3 shows a detailed sectional view of a portion of another alternative embodiment of the invention.--.

Signed and Sealed this

Twenty-fourth Day of November, 1992

*Attest:*

*Attesting Officer*

DOUGLAS B. COMER

*Acting Commissioner of Patents and Trademarks*